United States Patent [19]

Suzuki

[11] Patent Number: 4,701,665

[45] Date of Patent: Oct. 20, 1987

[54] COLOR CATHODE-RAY TUBE

[75] Inventor: Yoshio Suzuki, Fukaya, Japan

[73] Assignee: Tokyo Shibaura Denki Kabushiki Kaisha, Kawasaki, Japan

[21] Appl. No.: 838,190

[22] Filed: Mar. 7, 1986

Related U.S. Application Data

[63] Continuation of Ser. No. 563,988, Dec. 21, 1983, abandoned.

[30] Foreign Application Priority Data

Dec. 23, 1982 [JP] Japan ..... 57-194088[U]

[51] Int. Cl.[4] ..... H01J 29/07

[52] U.S. Cl. ..... 313/402; 313/408

[58] Field of Search ..... 313/402, 403, 407, 408; 445/36, 37

[56] References Cited

U.S. PATENT DOCUMENTS 3,652,895 3/1972 Tsuneta et al. ..... 313/403

FOREIGN PATENT DOCUMENTS 52-49764 4/1977 Japan ..... 313/403
52-58359 5/1977 Japan ..... 313/403
52-74278 6/1977 Japan ..... 313/402
58-157039 9/1983 Japan ..... 313/402
1442877 7/1976 United Kingdom ..... 313/402

*Primary Examiner*—Palmer C. DeMeo
*Assistant Examiner*—Sandra L. O'Shea
*Attorney, Agent, or Firm*—Cushman, Darby & Cushman

[57] ABSTRACT

In the shadow mask of a color cathode-ray tube, the array direction of in-line electron guns is parallel with the horizontal axis, and the radius of curvature along the horizontal axis of the plate portion of the shadow mask is so set as to be greater than that along the vertical axis thereof. The horizontal pitch of the apertures formed in the plate portion of the shadow mask is increased from the center region of the plate portion toward the periphery of the plate portion along the vertical axis.

8 Claims, 6 Drawing Figures

COLOR CATHODE-RAY TUBE

This is a continuation of application Ser. No. 563,988, filed Dec. 21, 1983, which was abandoned upon the filing hereof.

BACKGROUND OF THE INVENTION

The present invention relates to a color cathode-ray tube having a shadow mask and, more particularly, to the structure of the shadow mask of the color cathode-ray tube.

In a conventional color cathode-ray tube, a funnel section having a neck extending along the tube axis is hermetically sealed to a glass panel section, in such a way as to form an envelope. In-line electron guns are provided for emitting electron beams of the primary colors of red, blue and green; and a convergence device for super-imposing the electron beams from the electron guns are received in the neck. A deflection yoke device for deflecting electron beams from the electron guns is arranged around the funnel section. A phosphor screen is formed on the faceplate of the glass panel section and emits light upon the landing of electron beams on red, blue and green phosphor dots. A shadow mask is arranged within the glass panel section, in such a way as to oppose the phosphor screen. The plate portion of the shadow mask has a number of apertures which are regularly arrayed on the horizontal and vertical axes, respectively. The skirt portion of the shadow mask extends from the periphery of the plate portion along the tube axis.

The shadow mask is an important member which has a color selection function in determining the landing positions of the electron beams on the phosphor screen. In other words, when the electron beams converge at the correct angle, the shadow mask allows for the passage of the incident electrons, in such a way that each electron beam lands on its respective color dot on the phosphor screen, without straddling the other two color dots. When the electrons are incident on the shadow mask at an incorrect angle, the shadow mask interrupts the electrons.

When the array direction of a plurality of electron guns arranged in an in-line arrangement and normal to the tube axis is defined as a horizontal axis and the direction normal to the horizontal axis and the tube axis is defined as a vertical axis, the ratio of the size of the plate portion along the horizontal axis to that along the vertical axis is set at about 4:3. The plate portion has a curved surface corresponding to the phosphor screen and the curved surface is defined as a spherical portion of either a constant radius of curvature of a compound radius of curvature involving different radii of curvature. As shown in FIG. 1; in the plate portion of the shadow mask, when a radius of curvature along the horizontal axis and that of along the vertical axis are designated by RH and RV, respectively, the following relation exists:

$$RH < RV \tag{1}$$

This is shown in, for example, in U.S. Pat. No. Re. 27,259 (Japanese Utility Publication No. 50-6292), issued on Nov. 28, 1971, which discloses a design method of the shadow mask. According to this design method, when the distance from a plane contiguous with the center of the shadow mask and perpendicular to the tube axis to a given point on the shadow mask is designated by z, and distances from the tube axis to given points on the shadow mask, along the horizontal and vertical axes, are designated by x and y, respectively, distance z is given by equation (2) or (3), as follows:

$$z = RV - \sqrt{(RV - a)^2 - y^2} \tag{2}$$

$$\text{where } a = RH - \sqrt{RH^2 - x^2}$$

$$z = RH - \sqrt{(RH - b)^2 - x^2} \tag{3}$$

$$\text{where } b = RV - \sqrt{RV^2 - Y^2}$$

In this embodiment, the radius of curvature RH of the shadow mask along the horizontal axis is determined to be normally smaller than the radius of curvature RV thereof along the vertical axis, and may be given, for example, by the following equation (4):

$$RH = 0.88RV \pm 10\% \tag{4}$$

As given by equation (1), the radius of curvature RV of the shadow mask along the vertical axis is determined to be greater than the radius of curvature RH along the horizontal axis, for the following reason.

When the shadow mask is designed by a central radius of curvature RO which is equal to an axial distance between the deflection center and the center of the plate portion, one may assume that the center radius of curvature RO provides a complete sphere, and the distance between the deflection center and any region on the plate portion is constant. In this case, the electron beams for red, blue and green are converged in the aperture of the shadow mask, to provide a screen with low distortion in the electron beam spot. In this case, the phosphor screen should be designed to be a complete sphere having a constant radius of curvature. However, when the phosphor screen is formed into the complete sphere portion, it is difficult to comfortably monitor a picture image. In practice, therefore, the radius of curvature RV or RH of the plate portion is set to be greater than the axial distance RO between the center of the plate portion and the deflection center. That is, the plate portion is therefore kept as flat as possible. However, a convergence error is produced in the peripheral region of the phosphor screen due to the difference between the preset radius of curvature RV or RH and the axial distance RO between the center of the plate portion and the deflection center. In the vertical direction, a lateral distance from the center of the plate portion to the periphery thereof is relatively small, and the convergence error is relatively small. Accordingly, the radius of curvature RV in the vertical direction may be so set as to be relatively great and the plate portion may be formed into a relatively flat surface in the vertical direction. On the other hand; in the horizontal direction, since a longitudinal distance from the center of the plate portion to the periphery thereof is relatively great, the radius of curvature RH in the horizontal direction must be so set as to be smaller than that in the vertical direction RV, due to the correction limit of a dynamic convergence device which corrects the convergence error.

However, in the color cathode-ray tube described above, the distance between the plate portion of the shadow mask and the phosphor screen (which distance must be kept at a predetermined value, which is referred to as the Q value) is changed, due to the thermal deformation of the shadow mask during the operation of the color cathode-ray tube. If such thermal deformation exceeds the beam landing tolerance, one electron beam lands over two phosphor dots, causing color misregistration. In a general color cathode-ray tube having a shadow mask, the number of electrons passing through the aperture is about ¼ of the total number of the electrons emitted from the electron gun, the remainaing electrons being interrupted by the shadow mask and heating the shadow mask. Meanwhile, the shadow mask comprises a metal thin plate having a thickness of from 0.1 to 0.3 mm and made of iron due to ease in forming the apertures and to manufacturing cost. For these reasons, the plate portion which is thus heated exhibits the doming phenomenon due to thermal expansion wherein it is deformed to project outward, as indicated by the imaginary line in FIG. 2. This results in a change in the Q value and degrades the color purity.

SUMMARY OF THE INVENTION

A primary object of the present invention is to provide a color cathode-ray tube having a shadow mask, which supresses the doming phenomenon which is liable to result in a phosphor screen, and prevents any degradation in color purity.

According to one aspect of the present invention, there is provided a color cathode-ray tube having a tube axis, comprising a glass panel having a curved inner surface, a phosphor screen formed on the curved inner surface of said glass panel, electron gun means for emitting electron beams toward said phosphor screen, which includes a plurality of electron gun in an in-line arrangement defining a horizontal axis normal to the tube axis and a vertical axis normal to the horizontal the tube axes, a shadow mask including a curved plate portion which faces the inner surface of said glass panel and has a number of apertures for allowing the electron beams to pass through, and a skirt portion which is extended from the periphery of said plate portion along the tube axis, the radius of curvature of said plate portion along the horizontal axis being greater than the radius of curvature of the plate portion along the vertical axis.

DETAILED DESCRIPTION OF THE PREFERRED EMBODIMENT

A color cathode-ray tube according to the present invention may be described as follows, with reference to the accompanying drawings.

Figure 3:
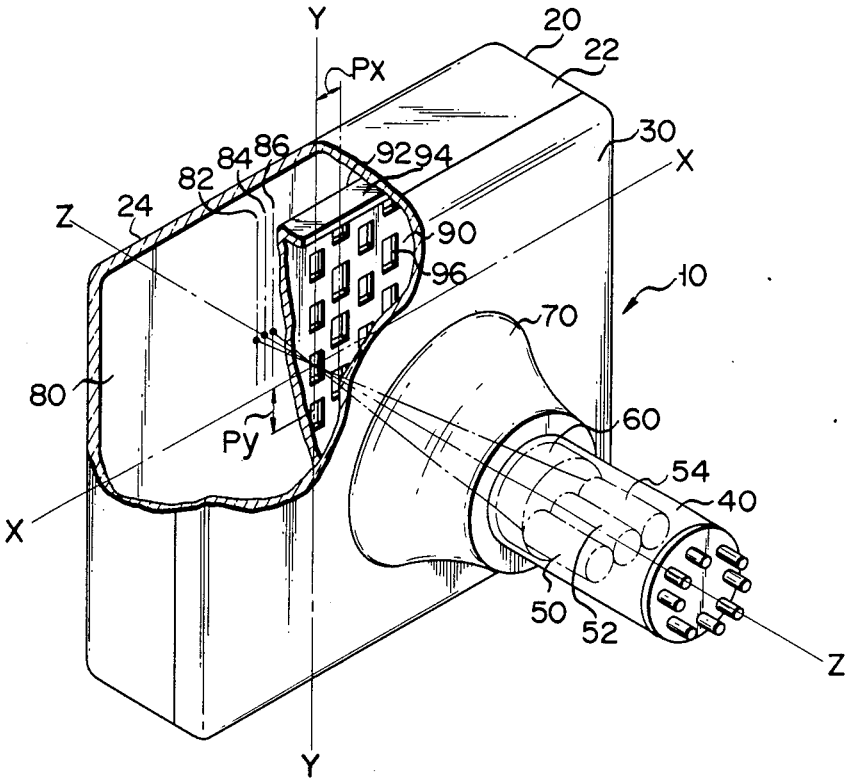
FIG. 3 is a partially cutaway schematic perspective view of a color cathode-ray tube according to the present invention.

With reference to FIG. 3, the color cathode-ray tube has an envelope 10, wherein a funnel section 30 with a neck 40 substantially extending along the tube axis Z—Z is hermetically sealed to the skirt 22 of a glass panel section 20. The neck 40 receives therein three in-line electron guns 50, 52, 54, which are arranged in line parallel with the horizontal axis X—X and emit electron beams of primary colors, i.e., of red, blue and green; and a convergence device 60 for super-imposing the electron beams from the electron guns 50, 52, 54. A deflection yoke device 70 for deflecting electron beams is arranged around the funnel section 30. A phosphor screen 80 for emitting light, upon the landing of electron beams on the red, blue and green phosphor dots 82, 84, 86 thereon, is formed on the inner surface of a faceplate 24 of the glass panel section 20. A shadow mask 90 having a curved plate portion 92 and a skirt portion 94 is received in the glass panel section 20. The plate portion 92 is formed into a substantially rectangular form and faced to the phosphor screen 80. The plate portion 92 has a number of apertures 96 which are arranged along the horizontal and vertical axes X—X and Y—Y. The skirt portion 94 extends from the peripheral edge of the plate portion 92, along the tube axis. The ratio of the dimensions of the plate portion 92 of the shadow mask 90, along the horizontal and vertical axis X—X and Y—Y, is substantially set at 4:3.

In the color cathode-ray tube, the shadow mask 90 is an important member with a color selection function which assists in determining the landing positions of the electron beams on the phosphor screen 80, by means of the apertures 96. In other words, when the electron beams converge at the correct angle into the aperture 96, the shadow mask 90 allows the electrons to pass therethrough, so that each electron beam lands on its respective color, without straddling the other two colors among the red, blue and green dots or strips 82, 84 and 86. On the other hand, when the electron beams are converged at an incorrect angle, the shadow mask 90 blocks the electrons.

Figure 4:
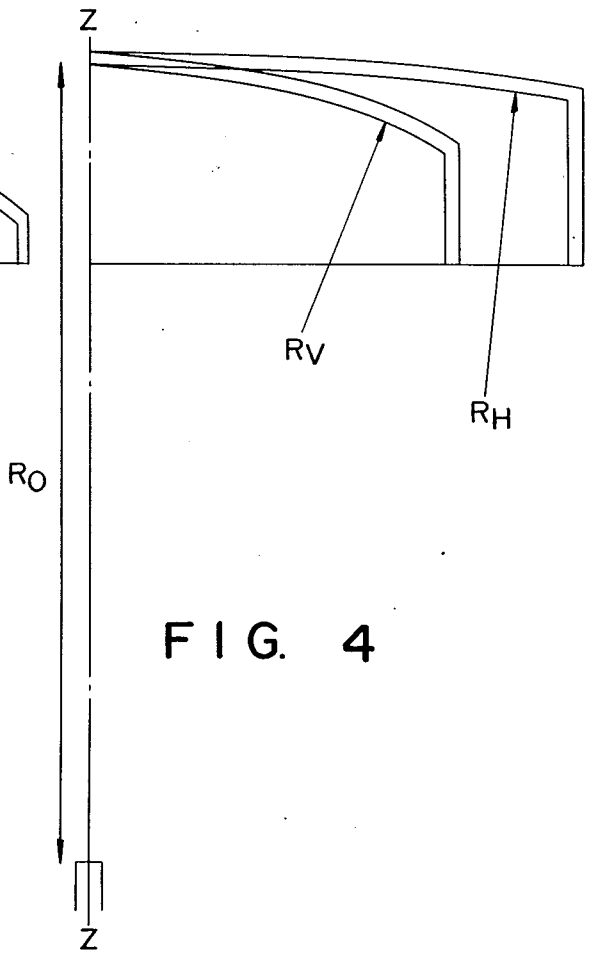
FIG. 4 is a partial sectional view of the shadow mask shown in FIG. 3 along the horizontal and vertical axis.
Figure 1:
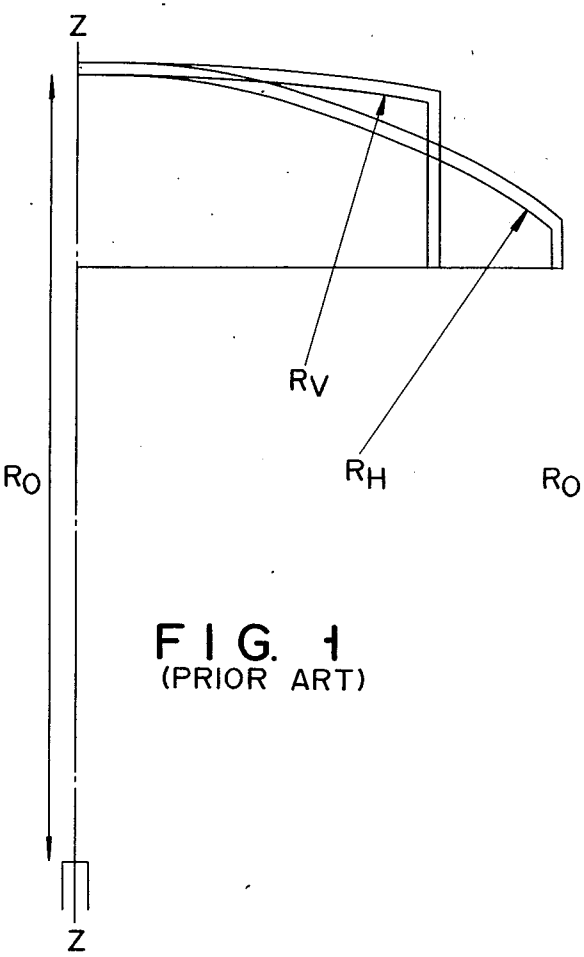
FIG. 1 (PRIOR ART)
FIG. 1 is a partial sectional view of a conventional shadow mask along the horizontal and vertical axes.

As shown in FIG. 4, the plate portion 92 of the shadow mask 90 according to the present invention is curved with radii of curvature RH and RV in the horizontal and vertical axis X—X and Y—Y, respectively. To supress the doming phenomenon, the radii of curvature RH and RV are determined in a following relation (5) which is unlike the case of the conventional relation (1).

$$RH > RV \tag{5}$$

This relation (5) is based on the following study of the inventors in respect to the doming phenomenon.

Figure 2:
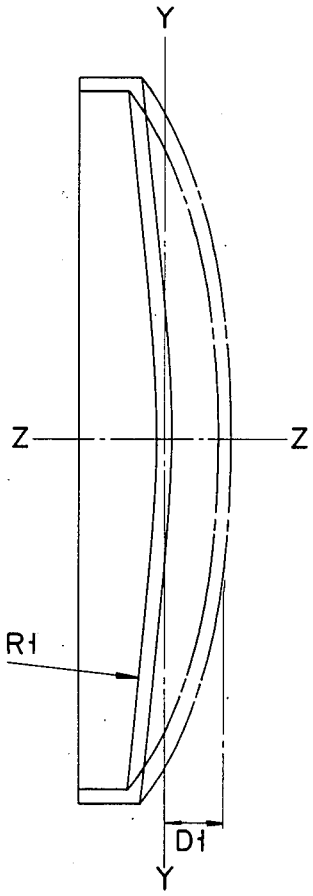
FIG. 2 (PRIOR ART)
FIG. 2 is a cross sectional view of the conventional shadow mask, showing the thermal deformation of a plate portion.
Figure 5:
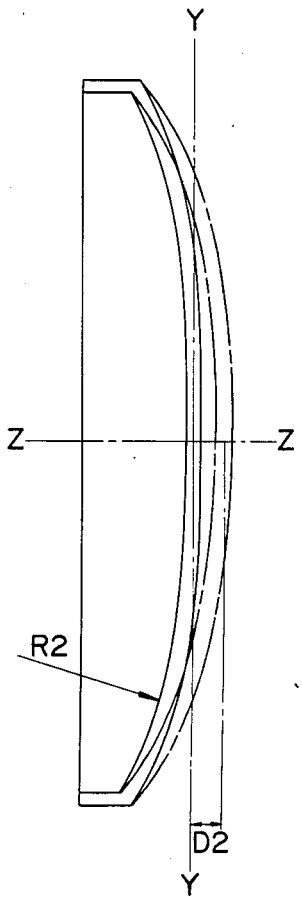
FIG. 5 is a cross sectonal view of the shadow mask shown in FIG. 3, showing the thermal deformation of a plate portion.

In the doming phenomenon, the degree of doming generally depends on the radius of curvature of the plate portion or the flatness of the plate portion. When the plate portions having different radii of curvature R1 and R2 are heated, the plate portions are deformed along the tube axis Z as shown in FIGS. 2 and 5. If the radius of curvature R1 is greater than the radius of curvature R2 or the plate portion shown in FIG. 2 is flatter than the that shown in FIG. 5, the $D1 >> D2$ relation is established, where D1 is the distance, at the center of the shadow mask, between the normal position indicated by the solid line of the shadow mask shown in FIG. 2 and the deformed position indicated by the imaginary line; and where D2 is the similar distance at the center of the shadow mask shown in FIG. 5. With a flatter shadow mask having a larger radius of curvature, the degree of doming increases. When this proportionality relation is applied to the conventional shadow mask shown in FIG. 2, the degree of doming is larger in the vertical direction Y—Y, as compared to that in the horizontal direction X—X in proportion to the radii of curvature given in equation (1). The mechanical strength of the shadow mask is large in the vertical direction Y—Y wherein the distance between opposing skirt sides is short, as compared to that in the horizontal direction X—X wherein this distance is large. Accordingly, the degree of doming of the shadow mask is substantially determined by the radius of curvature RV in the vertical direction. That is, the deformation of the plate portion in the vertical plate defined by the vertical axis Y—Y and the tube axis Z—Z affects the deformation of the plate portion in the horizontal plane defined by the horizontal axis X—X and the tube axis Z—Z to increase the degree of doming.

Under the above described study of the inventors, the relation (5) is established.

However, the shadow mask satisfying relation (5) cannot be applied to the various conventional color cathode-ray tubes, without incorporating therein some suitable means.

As one such suitable means, one may first consider the possibility of rendering the inner surface of the faceplate 24 of the glass panel section 20 having the phosphor screen 80 similar to the curved surface of the plate portion 92 of the shadow mask 90. When the distribution of the radius of curvature on the inner surface of the glass panel section 20 is similar to that of the plate portion 92 of the shadow mask 90 satisfying relation (5), the doming phenomenon, which is caused by the thermal deformation of the shadow mask 90, can be prevented; and, hence, degradation of the color purity may be avoided. However, in this case, the shadow mask 90 can be assembled in only a glass panel section 20 similar to the shadow mask 90 and may not be assembled in various type glass pannel sections 20 in the conventional color cathode-ray tube.

For the above reason, the present inventors studied the shadow mask having apertures which allow electrons to pass therethrough, to find a way of applying the shadow mask 90 satisfying relation (5) to various type glass pannel sections in the conventional color cathode-ray tube, without requiring a special member or an additional manufacturing step.

In the plate portion 92 of the shadow mask 90 wherein the apertures 96 are arranged with vertical and horizontal pitches Py and Px along the horizontal and vertical axes X—X and Y—Y, respectively, it is recognized that the radius of curvature RV in the vertical plane can be made small when the horizontal pitches Px are increased depending on the distance from the horizontal axis X—X toward the periphery of the plate portion 92 along the vertical axis Y—Y.

The optimum value of the horizontal pitch Px of the apertures 96 is substantially proportionate to value Q, i.e., is proportionate to the distance between the plate portion 92 of the shadow mask 90 and the phosphor screen 80. Value Q may be increased if the horizontal pitch Px of the apertures 96 is also increased. Accordingly, the radius of curvature RV along the vertical axis Y—Y may be minimized, by increasing the horizontal pitch Px of the apertures 96 from the horizontal axis X—X of the plate portion 92 toward the periphery of the plate portion 92 along the vertical axis Y—Y thereof.

In an embodiment of the present invention, the linear arrays of the apertures 96 are formed at a constant vertical pitch Py in a substantiallty vertical direction in such a manner that the apertures 96 are separated by bridges. The apertures 96 are arranged along horizontal reference lines parallel with the horizontal axis X—X. Each of horizontal pitches Px are defined as a distance between the adjacent linear arrays of the apertures 96 along horizontal reference lines. The horizontal pitches Px of the apertures 96 which are arranged along the arbitrary horizontal reference line are also set to be equal, but the horizontal pitches Px of the apertures 96 which are arranged along the different reference lines are set to be different values as to gradually increase depending on the distance from the horizontal axis X—X towards the pheriphery of the plate portion 92 along the vertical axis Y—Y.

Figure 6:
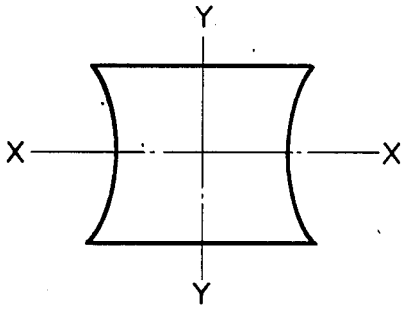
FIG. 6 is a schematic view showing a profile of the aperture arrangement shown in FIG. 3.

When the shadow mask 90 is manufactured to have the pitches Px and Py as described above, the aperture arrangement may be formed into a substantially pincushion shape where its dimension along the horizontal axis X—X is narrowest, as compared to that at the corresponding corners, as shown in FIG. 6. However, in practice, the inner surface of the faceplate 24 is designed to have a radius of curvature of about 800 mm, and the horizontal pitch Px of the apertures 96 arranged along the outermost horizontal reference line is so set as to be 1.2 times a center pitch of the apertures 96 in a center region of the plate portion 92. Thus, the phosphor screen 80 is not formed into the pincushion shape as shown in FIG. 6, because the inner surface of the face plate 24 is so formed as to have a convex profile in a vertical plane defined by the tube axis Z—Z and the vertical axis Y—Y.

When the horizontal pitches Px of the apertures 96 arranged along the outermost horizontal line are required to exceed a value which is 1.2 times the center pitch, the horizontal pitches Px of the apertures 96 arranged along each of the horizontal reference lines may be gradually decreased along its horizontal reference line, i.e., along the horizontal axis X—X from the center region of the plate portion to the peripheral region of the plate portion where the pitch is $Px_p$. The average value of the horizontal pitches Px of the apertures 96 arranged along the outermost horizontal line may be set to be 1.2 times the center pitch $Px_0$.

When the horizontal pitches Px of the apertures 96 arranged along the outermost horizontal line are set as to significantly exceed a value which is 1.2 times the center pitch $Px_0$, the horizontal pitches Px of the apertures arranged along each of the horizontal reference line may be gradually increased along its horizontal line so that the phosphor screen 80 is formed into a substantially rectangular shape. In this modified embodiment, the radius of curvature RH of the plate portion 92 in the horizontal plane, which is inversely proportionate to the horizontal pitch Px, may be descreased. However, the relation between the radii of curvatures RH and RV in the horizontal and vertical planes must be determined within the relation (5). In the modified embodiment, the radius of curvature of the overall plate portion 92 is decreased and the degree of doming proportionate to the radius of curvature of the plate portion of the shadow mask is also decreased, a better result is obtained.

In the description of the radius of curvature in the horizontal or vertical plane, radii of curvature RH and RV are respectively described as single values. However, they may also compound radii of curvature which gradually change, from the center of the plate portion 92 toward its periphery. Such compound radii of curvature may be given by approximation, upon the development of a polynomial.

What is claimed is:

1. A color cathode-ray tube having a tube axis, comprising:

a glass panel having a curved surface;

a fluorescent screen having a substantially rectangular shape and formed of a striped fluorescent layer, said screen being formed on the curved inner surface of said glass panel;

electron gun means for emitting electron beams toward said fluorescent screen, said gun means including a plurality of electron guns arranged in an in-line arrangement along a horizontal axis which is perpendicular to the tube axis; and a shadow mask including:

(a) a curved effective portion having a shape similar to the inner surface of said glass panel and facing said glass panel at a short distance therefrom, said curved effective portion having a number of slit-like apertures through which the electron beams pass; and (b) a skirt portion extending from the vicinity of said effective portion, substantially parallel to the tube axis;

wherein: (a) the radius of curvature RH of said effective portion along the horizontal axis is greater than the radius of curvature RV of the effective portion along the vertical axis and (b) wherein a horizontal pitch Px of said apertures increases in the vertical direction toward a peripheral part thereof, so that the following relationship is established between the pitch $Px_0$ in the vertically central part and the pitch $Px_p$ in the vertically peripheral part: $Px_p \leqq 1.2Px_0$.

2. A color cathode-ray tube according to claim 1, wherein the horizontal pitch of said apertures along the horizontal axis is gradually increased from the center region of the plate portion toward the periphery region of said plate portion along the vertical axis.

3. A color cathode-ray tube according to claim 1, wherein said phosphor screen is formed into a substantially rectangular form.

4. A color cathode-ray tube according to claim 1, wherein said apertures are arranged along horizontal reference lines which are parallel with the horizontal axis.

5. A color cathode-ray tube according to claim 4, wherein said apertures are arranged at constant vertical pitches.

6. A color cathode-ray tube according to claim 4, wherein horizontal pitches of the apertures arranged along each of the horizontal reference lines are substantially equal and the horizontal pitches of the apertures arranged along the different horizontal reference lines are set to be different value.

7. A color cathode-ray tube according to claim 4, wherein horizontal pitches of the apertures arranged along each of the horizontal reference lines are gradually increased from the center region of the plate portion towards the periphery thereof along its reference line.

8. A color cathode-ray tube according to claim 4, wherein horizontal pitches of the apertures arranged along each of the horizontal reference lines are gradually decreased from the center region of the plate portion towards the periphery thereof along its reference line.

* * * * *